US006164770A

United States Patent [19]

Takata

[11] Patent Number: 6,164,770

[45] Date of Patent: Dec. 26, 2000

[54] INK CARTRIDGE AND INK JET PRINTER USING THE SAME

[75] Inventor: Masayuki Takata, Nagoya, Japan

[73] Assignee: Brother Kogyo Kabushiki Kaisha, Nagoya, Japan

[21] Appl. No.: 09/131,669

[22] Filed: Aug. 10, 1998

[30] Foreign Application Priority Data

Aug. 22, 1997 [JP] Japan ..... 9-225942

[51] Int. Cl.[7] ..... B41J 2/175

[52] U.S. Cl. ..... 347/86; 347/85

[58] Field of Search ..... 347/36, 85, 86, 347/87

[56] References Cited

U.S. PATENT DOCUMENTS

| | | | |
|---|---|---|---|
| 4,928,126 | 5/1990 | Asai | 347/86 |
| 5,440,333 | 8/1995 | Sykora et al. | 347/87 |
| 5,574,490 | 11/1996 | Gragg et al. | 347/87 |
| 5,896,151 | 4/1999 | Miyazawa et al. | 347/86 |
| 5,949,458 | 9/1999 | Studholme | 347/86 |

FOREIGN PATENT DOCUMENTS

| | | | |
|---|---|---|---|
| 58-108153 | 6/1983 | Japan | 347/36 |
| 6-183023 | 7/1994 | Japan . | |
| 7-52399 | 2/1995 | Japan . | |

*Primary Examiner*—N. Le
*Assistant Examiner*—Anh T.N. Vo
*Attorney, Agent, or Firm*—Oliff & Berridge, PLC

[57] ABSTRACT

A cartridge case has an ink supplying opening. The opening is sealed with a sealing member through which a connector can penetrate. In the cartridge case, an ink container for storing the ink to be supplied to a printer head is fitted through a space to the ink supplying opening. The space is kept at a pressure that is less than atmospheric pressure. An ink absorbing material is disposed in the space adjacent to the sealing member. When the connector breaks through the sealing member, the ink inside the printer head is sucked into the space to make the inside of the printer head empty. Subsequently, the connector is connected to the ink container. Therefore, in the case where the needle-like hollow connector is connected, new ink can be supplied after the ink remaining in the printer head is sucked out.

23 Claims, 5 Drawing Sheets

INK CARTRIDGE AND INK JET PRINTER USING THE SAME

BACKGROUND OF THE INVENTION

1. Field of the Invention

The invention relates to an ink cartridge for storing ink to be supplied to a printer head, the ink cartridge being connectable to a needle-like hollow connecting member so as to supply ink to the printer head. The invention also relates to an ink jet printer using the same.

2. Description of Related Art

A conventional ink jet printer jets ink droplets out from a nozzle opening of a printer head to record an image on a recording medium, such as printing paper. Further, an ink cartridge for supplying ink to the printer head can be exchanged.

In such a conventional ink cartridge, a needle-like, hollow connector is connected to an ink supplying section so as to store ink to be supplied to a printer head and supply the ink to the printer head.

Such an ink cartridge is generally exchanged in a state that ink is charged into the printer head. When the ink is introduced in the exchange of the ink cartridge, the ink remaining inside an ink passage bubbles up and new ink collides with the remaining ink. As a result, the problems are caused that the ink is bubbled more easily, and the number of bubbles remaining inside the printer head and the ink passage extending to the printer head is greater than the case where ink is initially introduced in a state that the printer head is empty and has no ink.

In order to exchange the ink cartridge, the ink cartridge can be taken off, and then purging treatment for making empty can be carried out. Subsequently, a new cartridge can be fitted onto the printer. However, such a process requires very much labor and time, and is troublesome.

SUMMARY OF THE INVENTION

An object of the invention is to provide an ink cartridge that absorbs ink inside a printer head, and subsequently supplies new ink into the printer head, when an ink cartridge is joined to the printer head through a connecting member. It is also an object of the invention to provide an ink jet printer using the same.

Therefore, the first aspect of the invention is an ink cartridge which stores ink to be supplied to a printer head, and to which a needle-like hollow connecting member can be connected so as to supply the ink to the printer head. A cartridge case has an ink supplying opening. A sealing member seals the ink supplying opening of the cartridge case. The connecting member can penetrate through the sealed ink supplying opening. An ink container stores ink to be supplied to the printer head by its connection to the connecting member, and which is fitted through a space to the ink supplying opening, inside the cartridge case. The pressure in the space is kept at a reduced pressure which is less than atmospheric pressure.

According to the first aspect of the invention, the pressure inside the ink cartridge is kept at a reduced pressure. Therefore, in the case where the needle-like hollow connecting member is inserted into the sealing member to penetrate through it, the ink inside the printer head is sucked through the connecting member inside the space at the moment when the connecting member breaks through the sealing member, and then the connecting member is joined to the ink container.

Thus, during the exchange of a new ink cartridge, the ink inside the printer head is sucked through the connecting member without the use of restoring devices, and the printer head becomes empty. In this state, the printer head is joined through the connecting member to the ink container inside the ink cartridge. Therefore, it is possible to restrain the introduction of bubbled ink as was the case in the conventional art, and to maintain good recording performance even after the exchange of the ink cartridge. Since the pressure inside the space is kept a reduced pressure which is less than atmospheric pressure, the ink inside the ink container can be degassed satisfactorily over a long period.

In a preferred embodiment of the ink cartridge according to the invention, the space is filled up with an ink absorbing material which can absorb ink, at a position adjacent to the sealing member.

According to the preferred embodiment, in the case where the needle-like hollow connecting member is inserted into the sealing member to penetrate through it, the interior of the cartridge is kept at a reduced pressure at the moment when the connecting member breaks through the sealing member. Therefore, the ink is sucked through the connecting member and then the connecting member is joined through the space to the ink container. The space is filled up with the ink absorbing material which can absorb ink, at a position adjacent to the sealing member, and consequently the ink absorbing material can absorb the ink sucked through the connecting member to prevent the ink from scattering inside the ink cartridge.

In another preferred embodiment of the ink cartridge according to the invention, the ink container includes an ink pack in a bag form which has two opposing side faces. The ink pack is elastic so that it can be deformed. An urging member urges both the side faces in a direction that they extend away from each other.

According to this preferred embodiment, both the side faces of the ink pack n a bag form having elasticity for deformation are urged in the direction that they extend away from each other with the urging member, so that an interior of the ink pack is at a negative pressure. Thus, when the connecting member is stuck into the pack, leakage of the ink through the stuck portion can be avoided. Subsequently, negative pressure acts on the nozzle of the printer head, whereby leakage of the ink from the nozzle of the printer head can be also avoided during printing.

The second aspect of the invention is an ink jet printer including a printer head for jetting out ink on a recording medium to carry out printing thereon. An ink cartridge stores the ink. A cartridge fitting section, to which the ink cartridge is fitted, is freely put on and taken off from the section. A needle-like hollow connecting member is disposed at the cartridge fitting section and is connected to the ink cartridge when the ink cartridge is fitted onto the ink cartridge fitting section, so as to introduce the ink inside the ink cartridge to the printer head. The ink cartridge is any one of the aforementioned cartridges.

According to the second aspect of the invention, any one of the aforementioned ink cartridges is used as an ink cartridge which is fitted onto the ink cartridge fitting section. Accordingly, in the case where the ink cartridge is fitted onto the ink cartridge fitting section, the ink inside the printer head is sucked through the connecting member inside the space at the moment when the connecting member breaks through the sealing member. Subsequently, the connecting member is joined to the ink cartridge. Thus, it is possible to reduce bubbles remaining inside an ink passage extending the printer head without the use of restoring devices, and obtain good recording performance even after the exchange of the ink cartridge.

BRIEF DESCRIPTION OF THE DRAWINGS

A preferred embodiment of the invention will be described in detail with reference to the following figures wherein.

DETAILED DESCRIPTION OF THE PREFERRED EMBODIMENTS

The following will describe embodiments of the invention, referring the attached drawings.

Figure 1:
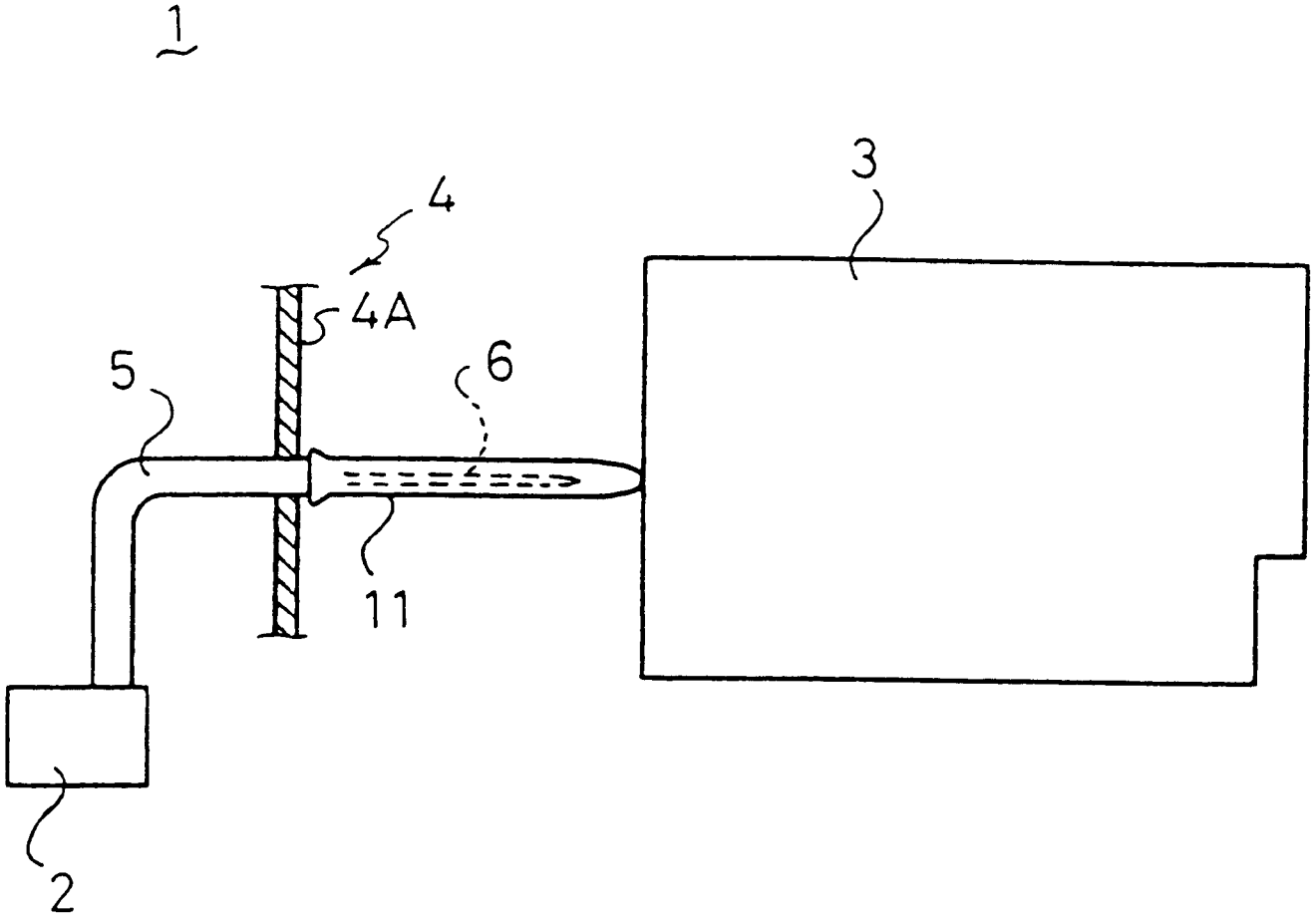
FIG. 1 is a view illustrating the schematic structure of an ink jet printer according to the invention.

FIG. 1 illustrates the schematic structure of an ink jet printer according to the invention. An ink jet printer 1 has a printer head 2 for jetting out ink onto a recording medium (not shown) to print an image thereon. Ink is supplied from an ink cartridge 3, which stores ink, into the printer head 2. The printer head 2 is mounted on a carriage (not shown) disposed so as to be advanced and returned along a direction of the width of the recording medium. The ink cartridge 3 is fitted onto a cartridge fitting section 4 so as to be freely put on and taken off. The cartridge fitting section 4 is arranged on the carriage.

The cartridge fitting section 4 has a vertical wall portion 4A, which is equipped with a hollow connector 6 in a needle-like form. The hollow connector 6 can be made of stainless steel. A protecting member 11, made of an elastic material having a shape restoring property, such as rubber, is disposed around the connector 6. The connector 6 penetrates through the protecting member 11 so as to be joined to the ink cartridge 3 when the ink cartridge 3 is fitted onto the cartridge fitting section 4 to be freely put on and taken off. By this joining, ink inside the ink cartridge 3 is introduced into the printer head 2 through an ink supplying tube 5.

Figure 2:
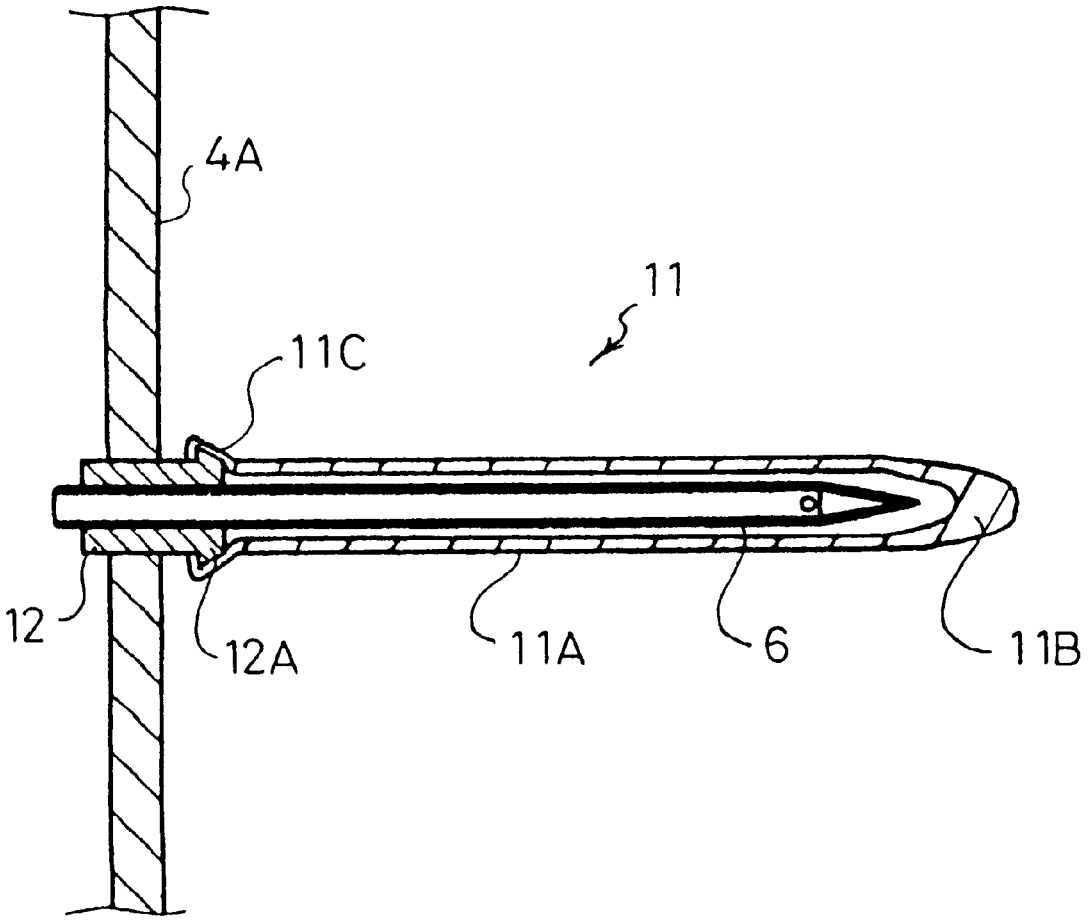
FIG. 2 is a view illustrating a structure on which a connector according to the invention is fitted.

Specifically, as shown in FIG. 2, the base portion of the connector 6 is fitted and fixed onto the wall portion 4A of the cartridge fitting section 4 through a cylindrical member 12. The cylindrical member 12 can be made of synthetic resin. The protecting member 11 has a cylindrical transformable portion 11A which is disposed around the connector 6 and can be transformed into the shape of a bellows. A tip protecting portion 11B is semi-spherical in shape and extends from one end of the transformable portion 11A. The tip of the connection member 6 penetrates through the tip protecting portion. An engaging portion 11C extends from the other end of the transformable portion 11A. The engaging portion 11C is engaged with, and fixed onto, the vicinity of a base portion (specifically, a flange portion 12A of the cylindrical member 12) of the connector 6. The tip protecting portion 11B is formed so as to be thicker than the transformable portion 11A, thereby heightening elastic strength. Thus, whenever engagement thereof with the ink cartridge 3 is released, the tip protecting portion 11B makes the portion through which the connector 6 penetrates contract and tight by elasticity of the tip protecting portion 11B per se. Thus, the ink cartridge 3 can be repeatedly used after the connector 6 penetrates through it.

Figure 3:
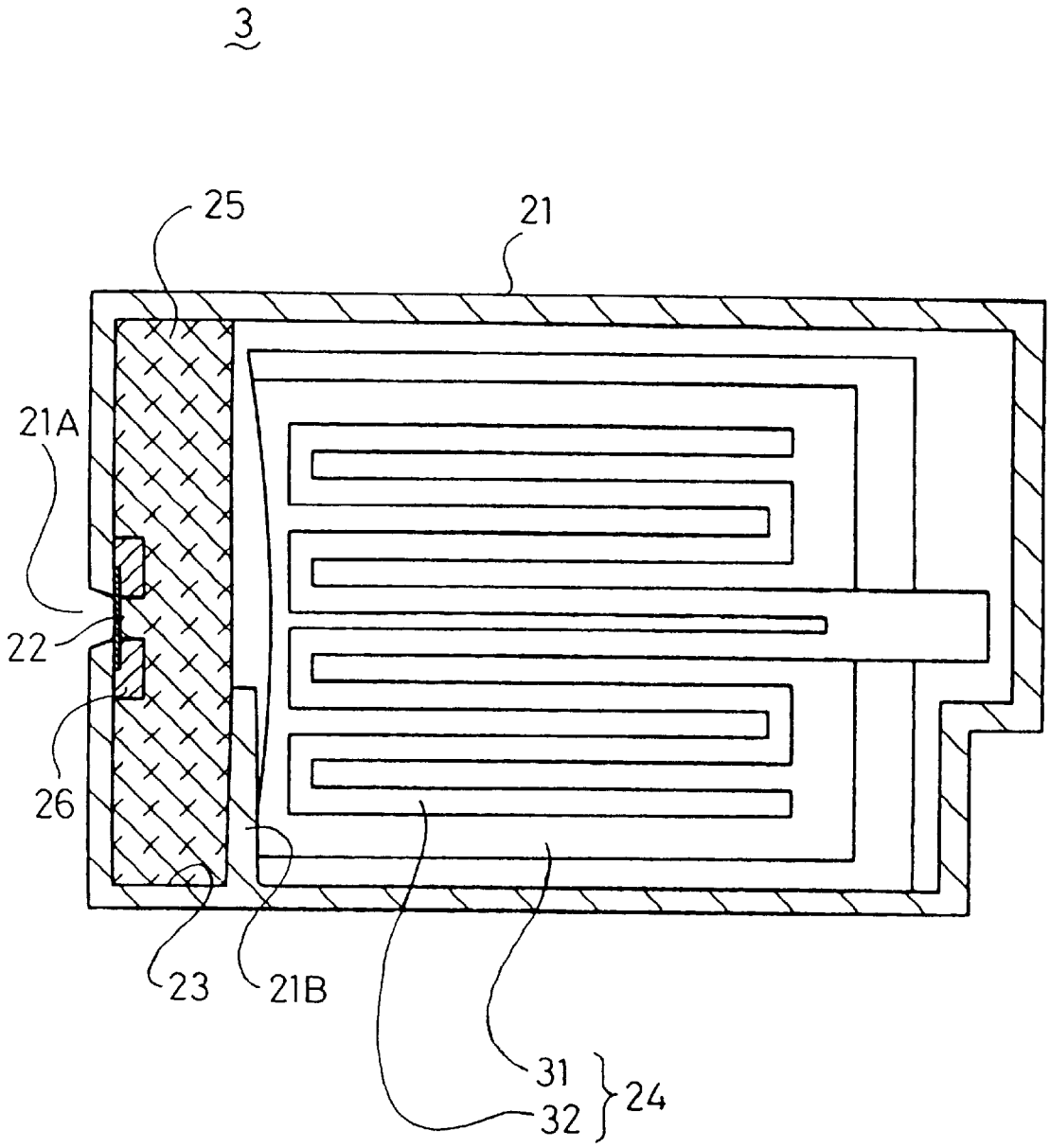
FIG. 3 is a cross sectional view illustrating the schematic structure of an ink cartridge according to the invention.

As shown in FIG. 3, the ink cartridge 3 is furnished with a cartridge case 21 having an ink supplying opening 21A. The cartridge case 21 can be made of synthetic resin. The ink supplying opening 21A of the cartridge case 21 is sealed with a sealing member 22 made of, for example, a rubber material. The sealing member 22 is fitted and fixed onto the inner surface of the cartridge case 21 with a fitting member 26, and is pierced with the needle-like hollow connector 6 so that the connector 6 penetrate through the sealing member 22.

An ink container 24 for storing ink is fitted, through a space 23, to the ink supplying opening 21A, inside the cartridge case 21. The ink inside the ink container 24 is supplied to the printer head 2 by connecting the container 24 to the connector 6.

The space 23 is kept at a reduced pressure, which is less than atmospheric pressure. Thus, the space around the ink container 24 is kept at a reduced pressure, so that the ink inside the ink container 24 is successfully degassed over a long period of time.

The space 23 is filled up with an ink absorbing material 25, made of a porous material which can absorb ink, at a position adjacent to the sealing member 22. The ink absorbing material 25 can be formed of sponge rubber having open cells, wherein the open cells include holes that communicate with each other. A portion of the ink absorbing material 25 contacts the inner face of the sealing member 22. The portion inside which the ink absorbing material 25 is arranged is divided from the portion inside which the ink container 24 is arranged by a separating wall 21B.

Figure 4:
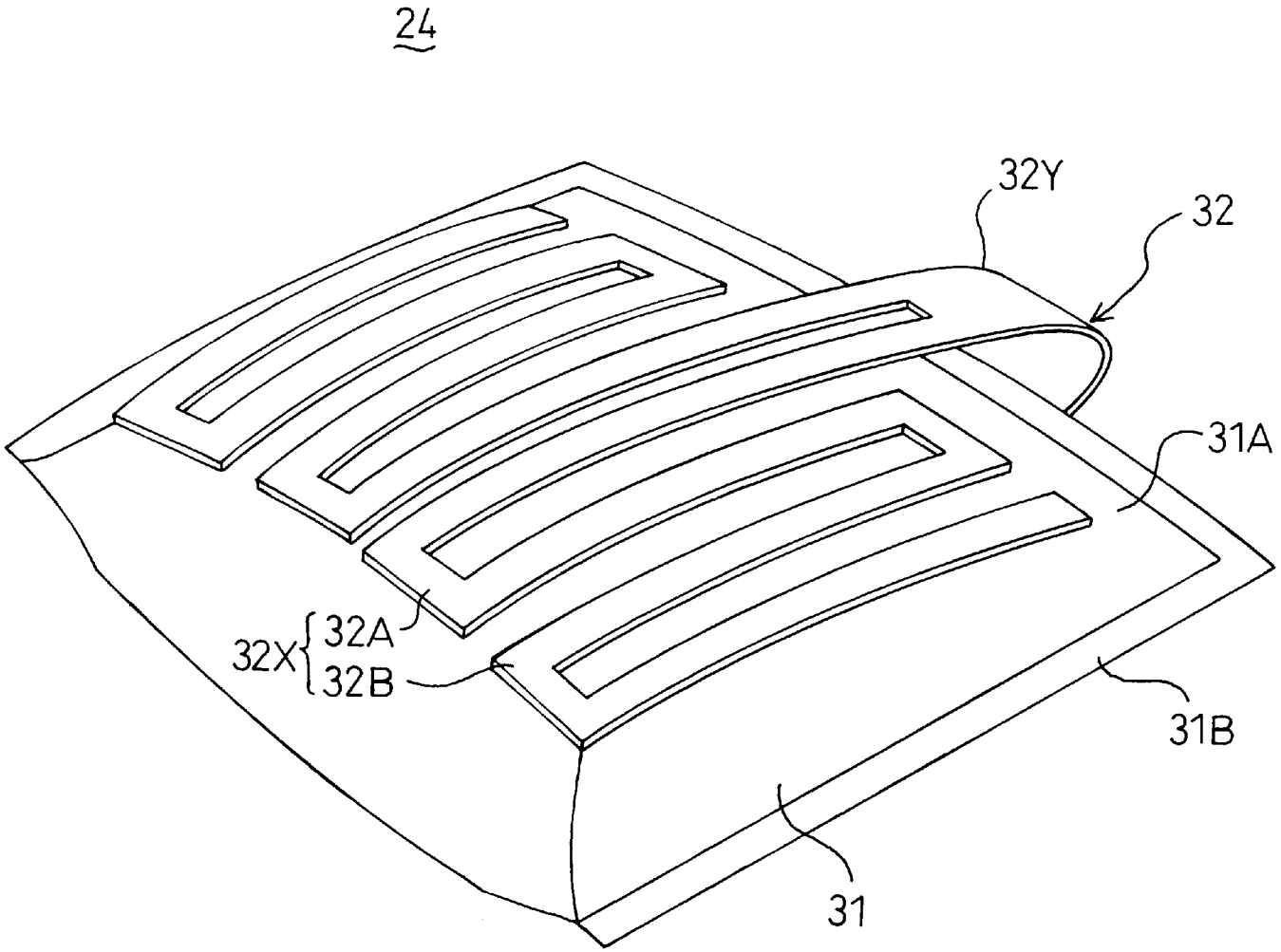
FIG. 4 is a perspective view of an ink container according to the invention.

As shown in FIG. 4, the ink container 24 includes a deformable and elastic ink pack 31 in a bag form which has two opposing side faces (only one side face 31A of which is illustrated). Ink is stored inside the elastic ink pack 31. A spring member 32 is an urging member in a plate form, and is disposed over substantially the entire exterior surface of each of the side faces. The spring member 32 urges in the direction that both the side faces extend away from each other. Urging the faces with the spring member 32 causes the ink inside the ink pack 31 to be stored under negative pressure. For this reason, even if the pressure inside the space 23 is returned to atmospheric pressure (the connector 6 breaks through the sealing member 22 so that pressure is gradually returned to atmospheric pressure), negative pressure acts on the nozzle of the printer head 2 when ink is supplied to the printer head 2 through the connector 6. Thus, ink from the nozzle is not leaked out.

The ink pack 31 is formed in a bag form by folding an elastic material in a sheet form and thermal melt-joining its peripheral portion 31B. The peripheral portion 31B, except the folded portion, that is, the "⊃"-shaped peripheral portion 31B, is less deformable than the other portions. Urging both the side faces 31A of the ink pack 31 in the direction that they extend away from each other causes the single folded portion to be kept perpendicular to both the side faces 31*a* and strained. As a result, the ink pack 31 can be easily pierced with the connector 6.

The spring member 32 in a plate form has two fixing portions (only one fixing portion 32X is illustrated) which are fixed onto the outer surfaces of both side faces of the ink pack 31, respectively. Both the fixing portions are connected to each other with a U-shaped joining section 32B extending over the end portion of the ink pack 31.

The fixing portions of the spring member 32 are in a plate spring form which extends, accompanied by being bent multiple times or curved, outwards from the point of joining the joining section 32B which is positioned at the center. Therefore, the peripheral portion of the spring member 32 is urged in the direction that the intervals become large by less power than the power generated at the central portion of the plate spring. Specifically, the fitting portion of the spring member 32 is formed symmetrically at right and left sides. Each of the sides has a first portion 32A, in a "⊃"-like shape, whose end is connected to the joining portion 32B, and the second portion 32B in a "⊃"-like shape and in parallel to the first portion 32A, whose end is connected to the other end of the first portion 32A, whereby the urging force by the spring member 32 is set to be smaller at a position away from the tip portion of the joined connector 6 than at a position closer to this tip portion, that is, the central portion of the fixing portion.

Figure 5A:
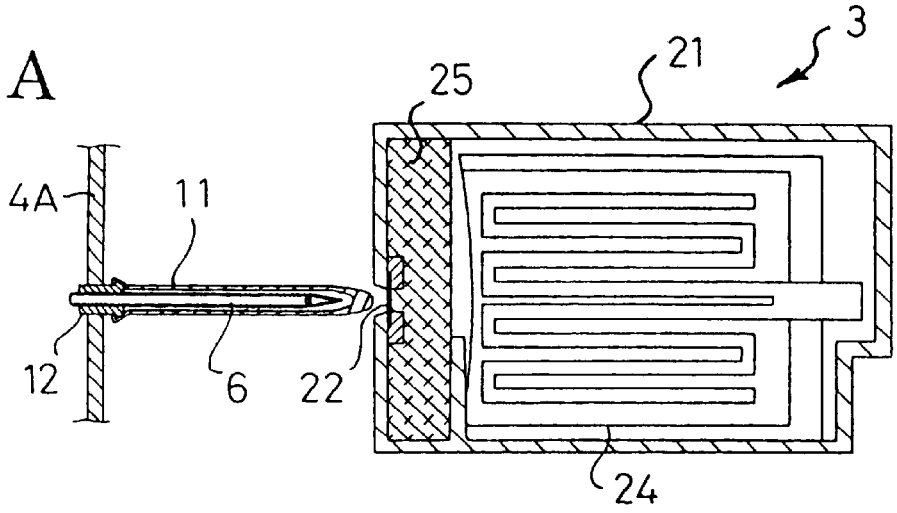
FIGS. 5A–5C are views illustrating the steps of fitting an ink cartridge according tithe invention.

As shown in FIG. 5A, according to the above structure, the protecting member 11 covers the entire needle-like, hollow connector 6 when the connector 6 is not connected to the ink cartridge 3, that is, when the ink cartridge 3 is not fitted onto the cartridge fitting section 4 and is not connected to the connector 6. In this state, the connector 6 is positioned inside the protecting member 11, thereby avoiding direct contact of the connection member 6 with a user's fingers and preventing dryness of the connector 6 and attachment of dust thereto.

Figure 5B:
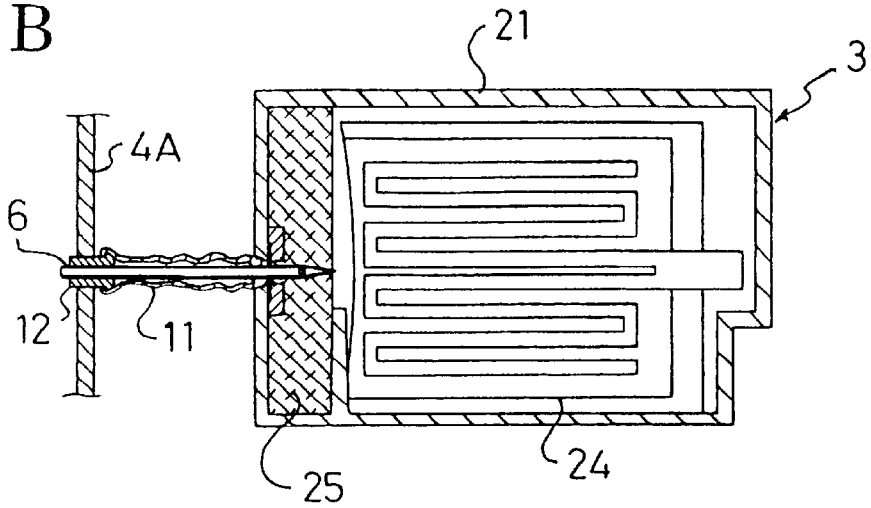

As shown in FIG. 5B, when the connector 6 is connected to a new ink cartridge 3 in order to, for example, exchange the used ink cartridge 3, the deformable portion 11A of the protecting member 11 is gradually deformed into the shape of a bellows by engagement thereof with the ink cartridge 3 (sealing member 22) so that the connector 6 penetrates through the tip protecting portion 11B and is exposed.

Figure 5C:
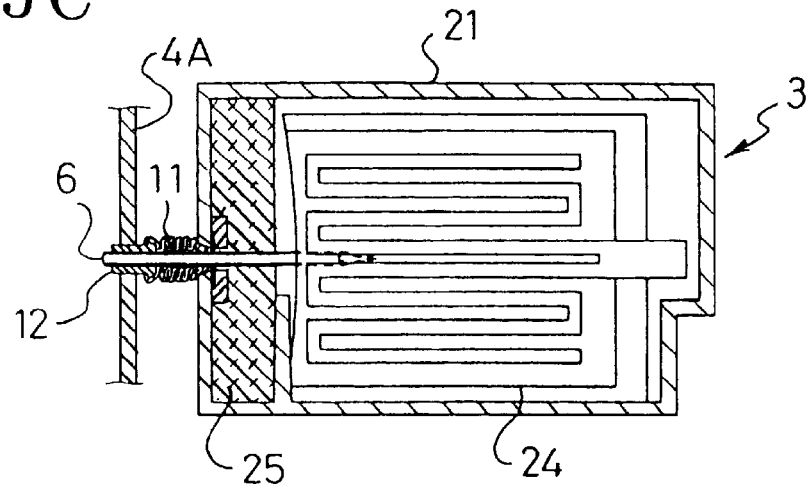

At this time, the needle-like hollow connector 6 is stuck into the sealing member 22 so as to penetrate through the sealing member 22. However, the pressure inside the ink cartridge 3 is kept at a negative pressure at the moment when the connector 6 breaks through the sealing member 22. Therefore, the ink inside the printer head 2 is sucked through the connector 6, and then, as shown in FIG. 5C, the connector 6 is stuck into the folded portion of the ink pack 31 to connect to the ink inside the ink pack 31.

Thus, during the fitting of the new ink cartridge 3, the ink inside the printer head 2 is sucked through the connector 6 so that the printer head 2 becomes empty, and in this state the printer head 2 is joined through the connector 6 to the ink container 24 inside the ink cartridge 3. In other words, by connecting the connector 6 to the ink cartridge 3, purging is performed without the use of restoring devices and high printing quality can be ensured even after the exchange of the cartridge.

Furthermore, the space 23 is filled up with the ink absorbing material 25 which can absorb ink at a position adjacent to the sealing member 22. Therefore, the ink which is sucked from the connector 6 is absorbed into the ink absorbing material 25 so that the ink is not scattered inside the ink cartridge 3.

In order to supply new ink to the printer head 2 after the connector 6 is stuck onto the one end of the ink pack 31, a known purging device is used to suck the ink inside the ink pack 31 from the nozzle of the printer head by negative pressure and introduce the ink to the printer head 2. Alternatively, the ink pack 31 may be pressurized to force the ink into the printer head 2. At this time, no ink remains inside the printer head 2. Therefore, it is possible to restrain the introduction of bubbled ink as in the conventional art and to print a high quality image.

What is claimed is:

1. An ink cartridge for storing ink to be supplied to a printer head, and to which a connecting member is connected so as to supply the ink to the printer head, comprising:

a cartridge case defining a space and an ink supplying opening;

a sealing member that seals the ink supplying opening of the cartridge case, the connecting member penetrating the sealing member; and an ink container disposed inside the cartridge case that stores the ink to be supplied to the printer head, the ink being supplied to the printer head by extending the connecting member through the ink supplying opening and the space so as to communicate with the ink container, a pressure in the space of the cartridge case, prior to being connected to the connecting member, being at a pressure that is less than atmospheric pressure.

2. The ink cartridge according to claim 1, wherein the sealing member is made of a rubber material.

3. The ink cartridge according to claim 1, further including a fitting member that fixes the sealing member to an inner surface of the cartridge case.

4. The ink cartridge according to claim 1, the ink cartridge being connectable to a needle-like hollow connecting member.

5. The ink cartridge according to claim 1, further including an ink absorbing material disposed in the space of the cartridge case adjacent to the sealing member, the ink absorbing material absorbing the ink.

6. The ink cartridge according to claim 5, wherein the ink absorbing material contacts an interior face of the sealing member.

7. The ink cartridge according to claim 5, wherein the absorbing material is at least partially separated from the ink container by a separating wall.

8. The ink cartridge according to claim 1, wherein the ink container includes a bag-like ink pack having two opposing side faces, the ink pack being elastic so as to be deformable, and an urging member that urges the side faces in a direction that they extend away from each other.

9. The ink cartridge according to claim 8, wherein the urging member includes a spring member in a plate form that extends over the two opposing side faces of the ink pack.

10. The ink cartridge according to claim 9, wherein the spring member has two fixing portions that are fixed onto an outer surface of each of the side faces of the ink pack.

11. The ink cartridge according to claim 10, wherein the spring member has a U-shaped joining section that connects the two fixing portions, the U-shaped joining section extending over an end portion of the ink pack.

12. An ink jet printer for use with a recording medium, comprising:

the ink cartridge for storing ink according to claim 1;

a printer head that jets ink onto the recording medium to perform printing thereon;

a cartridge fitting section to which the ink cartridge is removeably fitted; and a needle-like hollow connecting member disposed at the cartridge fitting section and connected to the ink cartridge when the ink cartridge is fitted onto the ink cartridge fitting section, so as to introduce the ink stored in the ink cartridge to the printer head.

13. The ink jet printer according to claim 12, wherein the cartridge fitting section includes a wall portion, and the connecting member includes a base portion, the base portion of the connecting member being fixed to the wall portion of the cartridge fitting section.

14. The ink jet printer according to claim 12, further including a protecting member disposed around the connecting member.

15. The ink jet printer according to claim 14, wherein the protecting member is made of an elastic material that has a shape restoring property.

16. The ink jet printer according to claim 14, wherein the connecting member penetrating through the protecting member.

17. The ink jet printer according to claim 14, wherein the protecting member has a cylindrical transformable portion disposed around the connecting member and that is transformable into a bellows shape.

18. The ink jet printer according to claim 17, wherein the protecting member has a semi-spherical tip portion that extends from one end of the cylindrical transformable portion.

19. The ink jet printer according to claim 18, wherein the protecting member has an engaging portion that extends from another end of the cylindrical transformable portion, the engaging portion being engageable at a base portion of the connecting member.

20. The ink jet printer according to claim 18, wherein the tip portion is thicker than the cylindrical transformable portion of the protecting member.

21. A method of supplying ink stored in an ink cartridge to a printer head, comprising the steps of:

sealing an ink supplying opening of a cartridge case of the ink cartridge with a sealing member;

providing a pressure in a space defined by the cartridge case at a pressure that is less than atmospheric pressure; and penetrating a connecting member through the sealing member and the space defined by the cartridge case so as to communicate with an ink container disposed inside the cartridge case, the pressure in the space defined by the cartridge case being at a pressure that is less than atmospheric pressure prior to being penetrated by the connecting member.

22. The method according to claim 21, wherein the penetrating step includes penetrating a needle-like hollow connecting member through the sealing member and the space defined by the cartridge case.

23. An ink jet printer for use with a recording medium, comprising:

ink cartridge means for storing ink, including a cartridge case and an ink container disposed inside the cartridge case;

means for sealing an ink supplying opening of the cartridge case of the ink cartridge;

means for providing a pressure in a space defined by the cartridge case at a pressure that is less than atmospheric pressure; and means for penetrating through the means for sealing and the space defined by the cartridge case so as to communicate with the ink container disposed inside the cartridge case, the pressure in the space defined by the cartridge case being at a pressure that is less than atmospheric pressure prior to being penetrated by the means for penetrating.

* * * * *